United States Patent [19]

Hofer et al.

[11] 4,413,253

[45] Nov. 1, 1983

[54] MINIATURE SOUNDER WITH DOUBLE TUNED CAVITY

[76] Inventors: Alan Hofer, Wantaugh; Frank M. Yama, Massapequa, both of N.Y.

[21] Appl. No.: 236,001

[22] Filed: Feb. 19, 1981

[51] Int. Cl.[3] ..... G08B 3/10

[52] U.S. Cl. ..... 340/388; 340/384 R; 340/392; 116/142 R; 181/160; 181/182; 181/198

[58] Field of Search ..... 340/388, 384 R, 384 E, 340/392; 181/148, 157, 192–194, 182, 183, 198, 199, 160, 182; 116/137 R, 142 R

[56] References Cited

U.S. PATENT DOCUMENTS

| | | | |
|---|---|---|---|
| 1,283,510 | 11/1918 | Heck | 181/182 |
| 3,327,808 | 6/1967 | Shaper | 181/156 |
| 4,183,017 | 1/1980 | Sims | 340/392 |
| 4,251,807 | 2/1981 | Hofer et al. | 340/388 |

*Primary Examiner*—Donnie Lee Crosland
*Attorney, Agent, or Firm*—Kane, Dalsimer, Kane, Sullivan and Kurucz

[57] ABSTRACT

A miniature sounder having a diaphragm closing one end of a tuned chamber. The other end of the chamber communicates with the interior of a tuned housing. The chamber and housing are both tuned to the desired oscillating frequency of the diaphragm with the chamber resonant frequency comprising substantially three times the desired frequency and twice the housing resonant frequency.

4 Claims, 2 Drawing Figures

MINIATURE SOUNDER WITH DOUBLE TUNED CAVITY

BACKGROUND OF THE INVENTION

The present invention relates to miniaturized sounders and in particular to a buzzer for a pocket paging device or the like.

Pocket pagers have gained wide use and acceptance in recent years. Such pages are commonly used by physicians, repair technicians, and others who must remain in contact with a central location. The pager, which corresponds in size roughly to that of a cigarette package, is carried in a pocket or clipped to the clothing of the user. In one common type of paging system, a radio signal at a particular frequency is generated when contact with the user is required. The radio signal serves to trigger an oscillator within the pager which, in turn, drives a buzzer. The user, upon hearing the buzzer, places a telephone call to the central location to receive his message.

Pocket pagers must be small enough to be comfortably carried by the user. In addition, the pager must be large enough to contain the buzzer along with its associated electronics and power supply. It is thus desirable to miniaturize the components of the pager as much as possible. This poses a particular problem with regard to the actual sounder since it must be capable of generating a sound sufficiently loud to insure attracting the user's attention regardless of ambiant noise conditions.

Therefore, various attempts have been made to produce such miniature sounders or buzzers. In one such attempt, a folded horn is positioned within a tuned cavity. This, however, requires precise tuning of the buzzer components.

In view of the above, it is the principal object of the present invention to provide an improved sounder which is small in volume but capable of producing a relatively loud, audible sound.

A further object is to provide such a sounder which is compatible with conventional pocket pager drive circuits and power sources.

A still further object is to provide such a sounder which is reliable, efficient and which may be constructed of a small number of components which may be readily assembled.

SUMMARY OF THE INVENTION

The above and other beneficial objects and advantages are attained by providing a miniature sounder comprising a double tuned cavity resonator.

The first cavity comprises a chamber one end of which is closed by a diaphragm which is operatively driven at a desired frequency. The diaphragm and chamber are positioned within a second cavity in the form of a rectangular housing. The chamber and housing are both tuned to the drive frequency of the diaphragm. The tuned frequency of the chamber is substantially three times that of the diaphragm and twice that of the housing.

When the diaphragm and chamber are in position a pocket is formed within the housing. An outlet opening is provided within the pocket.

DETAILED DESCRIPTION OF THE PREFERRED EMBODIMENT

Figure 1:
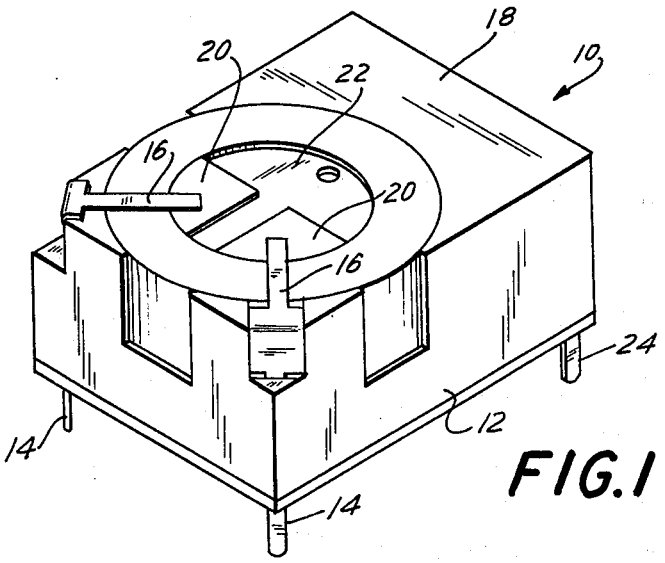
FIG. 1 is a perspective view of a miniature sounder in accordance with the present invention.

Reference is now made to the drawings and to FIG. 1 in particular wherein a miniature sounder 10 in accordance with the present invention is depicted. The sounder 10 is contained within a generally rectangular housing 12 formed of a suitable material such as ABS or the like. The length of housing 10 is approximately ⅝" and its width is approximately ½". The height of the housing is approximately 0.320.

A series of connectors extend from the bottom of the housing. A pair of connectors 14 have integral tabs 16 extending over the top surface 18 of the housing to engage the contacts 20 of a solder patch 22. The ends of a coil are similarly connected to the solder patch thereby permitting the coil to be activated through contacts 14. An additional pair of contacts 24 are provided opposite contacts 14. Contacts 24, in cooperation with contacts 14 facilitate seating and securing the sounder 10 in a socket in the pocket pager assembly or other device with which the sounder is to be used. Contacts 14 also serve to make electrical contact with an oscillator forming a part of the pager drive circuit. Such pagers are well known and are well defined in the art and form no part of the present invention. It should be noted, however, that the most commonly used frequency for such pager oscillators is 2070 Hz (nominal 2100 Hz).

Figure 2:
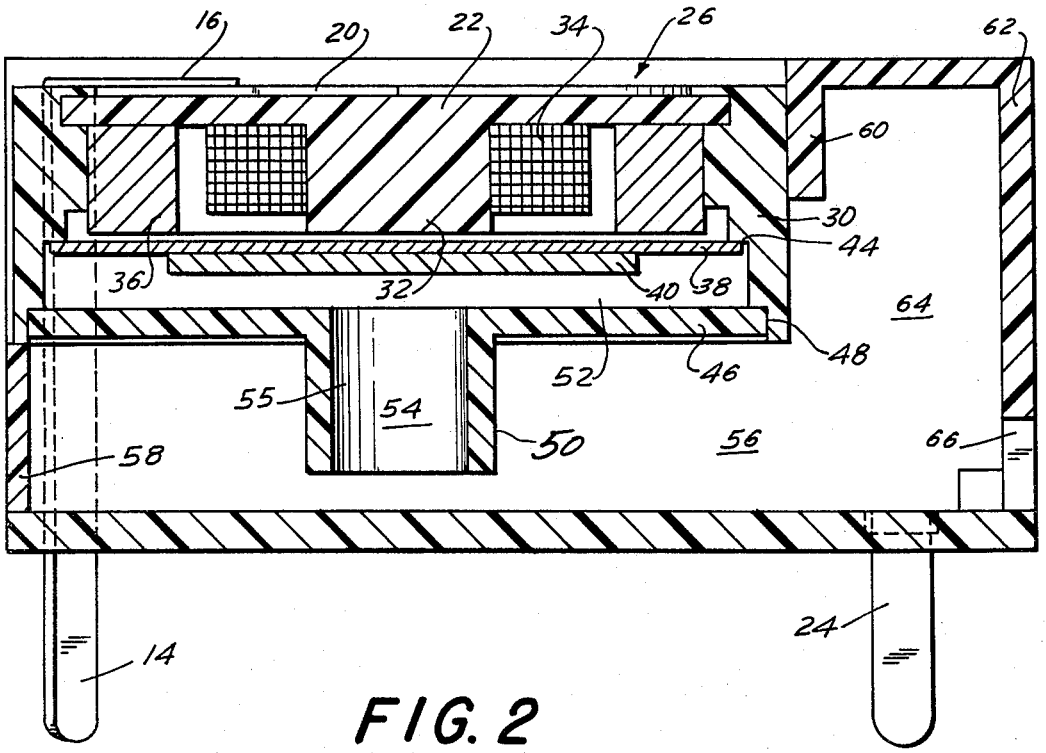
FIG. 2 is a side elevational sectional view of the sounder of FIG. 1.

Referring now to FIG. 2, it can be noted that there is contained at one end of the housing a driver generally designated 26. The driver 26 is of a conventional construction and may, for example, be constructed in accordance with the teachings of our commonly assigned U.S. Pat. No. 4,251,807 for MINIATURE BUZZER. In brief, the driver 26 consists of a plastic support collar 30 in which a pole piece 32 of a magnetic material is supported. A coil 34 is disposed about the pole piece. The ends of the coil 34 are drawn through the top of the unit for connection with contacts 14 through the solder patch 22. A ring magnet 36 surrounds the coil with its lower edge defining a common plane with the bottom of the pole piece.

A diaphragm 38 formed of a tempered magnetic material is positioned within collar 30 spaced below the bottom edge of the pole piece 32. An armature 40 of magnetic material is spot welded to the rear of the diaphragm (i.e., opposite to the pole piece). The diameter of the pole piece is less than that of the diaphragm but large enough to span the inner diameter of ring magnet 36. The diaphragm 38 fits onto a step 44 formed in collar 30. A closure plate 46 fits on a lower step 48 formed at the bottom of collar 30. A hollow tube 50 extends through plate 46. Thus, the lower portion 52 of collar 30 (i.e., below step 44) along with the bore 54 of tube 50 define a chamber 55 one end of which is closed by the diaphragm and the other end of which communicates with the interior 56 of housing 12 through the bottom end of tube 50.

The driver 26 is secured to one end of the housing as shown with collar 30 captured between a step 58 at the front end of the housing extending up from the bottom of the housing and a partial partition 60 extending downwardly from the top of the housing. It should be noted that partition 60 is spaced forwardly of the rear wall 62 of the housing so as to form a pocket 64 between the driver 26 and rear wall. An outlet opening 66 is formed in the rear wall.

By varying the diameter of collar 30 below diaphragm 38 and/or the distance between diaphragm 38 and plate 46 and/or the diameter and length of tube 50 the volume of the chamber and hence its resonant frequency may be altered. Similarly the resonant frequency of the housing may be altered by varying the distance between partition 60 and wall 62 and/or the height of the housing.

In a successful practice of the invention wherein the diaphragm was oscillated at 2070 Hz, the chamber 55 was tuned to 6200 Hz and the housing was tuned to 3100 Hz. The double tuned cavity resonator resulting from the tuned chamber and tuned housing produced an exceptionally loud audible tone.

Thus, in accordance with the above the aforementioned object were effectively attained.

Having thus described the invention, what is claimed is:

1. A miniature sounder comprising:

a diaphragm;

a surrounding rectangular housing disposed about said diaphragm;

a chamber within said housing having a first open end closed by said diaphragm and an opposite open end communicating with the interior of said housing;

an armature affixed to said diaphragm;

a magnetic circuit operatively connected to said armature for driving said diaphragm at a desired frequency;

said chamber and said housing being dimensioned so that each occupies a volume tuned to said desired frequency for driving said diaphragm so that said chamber resonant frequency comprises a multiple of said diaphragm driving desired frequency and a multiple of said housing resonant frequency and said diaphragm and chamber extend from one wall of said housing to a partial partition, and a pocket is defined between said partition and an opposite wall of said housing and an outlet opening is provided in said housing opposite wall.

2. The miniature sounder in accordance with claim 1 wherein said chamber resonant frequency is substantially three times said desired frequency and substantially twice said housing resonant frequency.

3. The miniature sounder in accordance with claims 1 or 2 wherein said diaphragm frequency comprises approximately 2070 Hz, said chamber is tuned to a resonant frequency of approximately 6200 Hz, and said housing is tuned to a resonant frequency of approximately 3100 Hz.

4. The miniature sounder in accordance with claims 1 or 2 wherein said housing is rectangular.

* * * * *